US005518558A

United States Patent [19]

Shoji et al.

[11] Patent Number: 5,518,558

[45] Date of Patent: May 21, 1996

[54] ALUMINUM ALLOY SHEETS EXCELLENT IN STRENGTH AND DEEP DRAWING FORMABILITY AND PROCESS FOR MANUFACTURING SAME

[75] Inventors: Ryo Shoji; Yoichiro Bekki, both of Tokyo, Japan

[73] Assignees: The Furukawa Electric Co., Ltd., Tokyo; Kawasaki Steel Corporation, Hyogo, both of Japan

[21] Appl. No.: 153,670

[22] Filed: Nov. 16, 1993

[30] Foreign Application Priority Data

Nov. 17, 1992 [JP] Japan ..... 4-330907

[51] Int. Cl.[6] ..... C22F 1/04

[52] U.S. Cl. ..... 148/693; 148/697; 148/700; 148/702; 148/415; 148/417; 148/439; 148/440

[58] Field of Search ..... 148/693, 697, 148/700, 702, 415, 417, 439, 440; 420/533, 542, 543, 545

[56] References Cited

U.S. PATENT DOCUMENTS 3,617,395 11/1971 Ford ..... 148/697

*Primary Examiner*—David A. Simmons
*Assistant Examiner*—Robert R. Koehler
*Attorney, Agent, or Firm*—Joseph J. Petrokaitis; Vineet Kohli; Thomas R. Morrison

[57] ABSTRACT

A high Mg content Al-Mg alloy sheet for press-forming, having superior strength and deep drawing formability. The alloy has intermetallic compounds containing Cr dispersed into the metal structure thereof. The mean grain diameter of the metal structure ranges from about 5 to 30 μm. The process for manufacturing the alloy is also disclosed. The composition of the alloy includes Al, Mg, Be, Cr, Ti, B, Cu Fe, Si and associated inevitable impurities.

9 Claims, 1 Drawing Sheet

(x 40,000)

0.5 μm (X 40,000) 0.5 μm (X 40,000) 0.5 μm

ALUMINUM ALLOY SHEETS EXCELLENT IN STRENGTH AND DEEP DRAWING FORMABILITY AND PROCESS FOR MANUFACTURING SAME

BACKGROUND OF THE INVENTION

This invention relates to a process for manufacturing aluminum alloy sheets. More particularly, the present invention is directed to aluminum alloy sheets suitable for press forming of auto body panels, air cleaners, oil tanks and other like products which require superior strength and formability.

In general, cold rolled steel sheets have been used for press forming of auto body panels or the like. Recently, however, there has been a great demand for aluminum alloy sheets instead of the cold rolled steel sheets. This substitution results in lighter auto bodies, which in turn improves the fuel consumption thereof.

Conventional aluminum alloy sheets having strength and formability, include O stock of Al-Mg alloy 5052 which consists essentially of a chromium alloy containing 2.5 wt. % of Al and 0.25 wt. % of Mg, 0 stock of Al-Mg alloy 5182 which consists essentially of a manganese alloy containing 4.5 wt. % of Al and 0.35 wt. % of Mg and T4 stock of Al-Cu alloy 2036 which consists essentially of a magnesium alloy containing 2.6 wt. % of Al, 0.25 wt. % of Cu and 0.45 wt. % of Mn.

Of the above mentioned alloy sheets, only the Al-Mg alloy sheets have both excellent deep drawing formability and strength. They are often used for deep drawing press-formed products such as inner members.

The prior art Al-Mg alloy sheets for press forming are normally manufactured by a process which includes forming slabs for rolling, homogenizing, hot rolling, cold rolling and final annealing. Additionally, an intermediate annealing step may be included prior to the cold rolling step. In cases requiring flat sheets, a straightening step is often carried out by either a tension leveler, a roller leveler, skin pass rolling or like means after the annealing step.

Conventional Al-Mg alloy sheets manufactured by the above process have superior formability when compared against other aluminum alloy sheets. However, they have inferior formability as compared to cold rolled steel sheets. Therefore, there is such a problem as the Al-Mg alloy sheet is easily cracked at the time of press forming, in comparison with the cold rolled steel sheet. Further, since the Al-Mg alloy sheets have inferior strength as compared to the cold rolled steel sheets, it is difficult to make the Al-Mg alloy sheets thinner. Thus, the overall goal of making lighter auto bodies cannot be obtained.

It is known that elongation of the Al-Mg alloy sheets can be substantially improved in proportion to the Mg content therein. Therefore, prior art methods for producing Al-Mg alloy sheets with improved elongation have attempted to increase the Mg content above that of the conventional Al-Mg alloy (2.5 to 5.0 wt. % of Mg).

For example, Japanese Patent Laid-open No. 4-147936 discloses an aluminum alloy sheet containing 4 to 8 wt. % of Mg, 0.05 to 0.7 wt. % of Cu, 0.01 to 0.3 wt. % of Mn and 0.002 to 0.01 wt. % of Be and having grain diameters in the range of 30 to 100 μm.

As a result of the high Mg content the Al-Mg alloy sheet has a high elongation percentage. Furthermore, since elongation is highly correlative with stretch forming formability, bending formability and flanging formability or the like, these properties are also improved due to the high Mg content.

However, conventional Al-Mg alloy sheets having high Mg content have the following disadvantages.

One drawback is that conventional Al-Mg alloy sheets having high Mg content is inferior in deep drawing formability to cold rolled steel sheets. In particular, when press forming is done under poor lubrication conditions as in the case of press forming of auto parts, the Al-Mg alloy sheets having high Mg content are easily cracked. This degrades productivity.

Although the strength of the conventional Al-Mg alloy sheets having high Mg content is greater than that of other aluminum alloy sheets, the strength is still inferior to that of the cold rolled steel sheets. Therefore, the conventional Al-Mg alloy sheets having with high Mg content cannot be made as thin as required to lighten the weight of auto bodies.

The present inventors have examined the above-mentioned problems of the conventional Al-Mg alloy sheets having high Mg content in detail. As a result, they have found that the higher the strength of a material, the better the deep drawing formability of an aluminum alloy sheet. Further, that an alloy sheet obtained by finely recrystallizing an Al-Mg alloy sheet with properly dispersed intermetallic compounds containing Cr has extremely high strength and has also excellent deep drawing formability.

SUMMARY OF THE INVENTION

It is an object of the present invention to provide an aluminum alloy sheet having the strength and deep drawing formability comparable to that of a cold rolled steel sheet by improving the metal structure of an Al-Mg alloy sheet having a high Mg content.

Another object of the present invention is to provide a process for manufacturing a high content aluminum alloy sheet with superior strength and deep drawing formability.

An aluminum alloy sheet according to a first embodiment comprises an aluminum alloy containing 5 to 10 wt. % of Mg, 0.0001 to 0.01 wt. % of Be, 0.01 to 0.05 wt. % of Cr, 0.005 to 0.1 wt. % of Ti or both 0.005 to 0.1 wt. % of Ti and 0.00001 to 0.05 wt. % of B, Fe and Si as impurities respectively wherein Fe and Si do not exceed 0.2 wt. %, and the remainder consisting of other inevitable impurities and Al. The metal structure of the aluminum alloy sheet has 0.1 to 0.5 vol. % of intermetallic compounds containing Cr with the mean diameter of not more than 0.2 μm dispersed therein. The mean grain diameter of the metal structure is within the range of 5 to 30 μm.

An aluminum alloy sheet according to a second embodiment comprises an aluminum alloy containing 0.05 to 1.0 wt. % of Cu in addition to the above-mentioned first embodiment.

A process for manufacturing an aluminum alloy sheet according to the invention comprises the steps of homogenizing an aluminum alloy slab which has the same composition as that of the aluminum alloy sheet in the above-mentioned invention, at 450° to 540° C. for not more than 24 hours. The homogenized aluminum alloy slab is then subjected to hot rolling to provide an aluminum alloy. Next, precipitation treatment of intermetallic compounds containing Cr is carried out at least once at 230° to 360° C. for 1 to 100 hours immediately after the hot rolling or before the cold rolling followed by the hot rolling. The resultant alloy sheet is then subjected to final cold rolling up to a predetermined thickness. Finally, the cold-rolled alloy sheet is heated at 400° to 500° C. for not more than 120 seconds.

Now, with reference to each element, other than aluminum, contained in the composition of the aluminum alloy sheet described above, a detailed description will be given about the reasons why these elements are selected and why the contents thereof are respectively restricted.

Mg is added to improve the strength and deep drawing formability of an aluminum alloy sheet.

When Mg content is less than 5 wt. %, the effect of adding Mg is insufficient. On the other hand, when the Mg content exceeds 10 wt. %, the hot workability of the alloy rapidly lowers, and becomes hard to manufacture.

Be is added to prevent the generation of casting cracks and to prevent oxidation of the molten metal at the time of melting and casting. Be also prevents the loss of Mg due to the oxidation of the slab during homogenization.

When Be content is less than 0.0001 wt. %, Be is ineffective. On the other hand, when the Be content exceeds 0.01 wt. %, a toxicity problem arises.

Cr is added to improve the strength and deep drawing formability of the alloy sheet without lowering the elongation percentage.

When Cr is dispersed into the metal structure of the alloy sheet as intermetallic compounds ($A_7Cr$ or $Al_{18}$ $Mg_3Cr_2$), which contain Cr with a mean diameter of 0.2 μm in the range of 0.1 to 0.5 vol. % by the precipitation treatment, the grains of the alloy sheet become finer. As a result, the alloy has improved strength and deep drawing formability.

When the mean diameter of the intermetallic compounds containing Cr exceeds 0.2 μm or the dispersed amount thereof is less than 0.1 vol. %, the effect of the dispersion of the intermetallic compounds containing Cr is small. On the other hand, when the dispersed amount exceeds 0.5 vol %, the elongation of the alloy sheet is lowered.

When the amount of Cr to be added is less than 0.01 wt. %, the dispersed amount of the intermetallic compounds containing Cr cannot be set to less than 0.1 vol. %. On the other hand, when the amount of Cr to be added exceeds 0.05 wt. %, the dispersed amount of the intermetallic compounds containing Cr exceeds 0.5 vol. %.

Ti or both Ti and B are added to improve the hot workability by homogeneously making the alloy slab structure finer. It also reduces the dispersion in strength and formability after the final annealing.

When Ti content is less than 0.005 wt. %, the effect of adding Ti is slight. On the other hand, when the Ti content exceeds 0.1 wt. %, coarse intermetallic compounds are formed which lower the elongation of the alloy sheet.

On the other hand, B coexists with Ti to further enhance fine slab structure. It is desirable to add B in the range of 0.00001 to 0.05 wt. %.

When B content is less than 0.00001 wt. %, the effect of B is small. On the other hand, when the B content exceeds 0.05 wt. %, coarse $TiB_2$ compounds are formed which lower the elongation of the alloy sheet.

Fe and Si are impurities in the alloy. The concentration of both Fe and Si should be regulated so as not to exceed 0.2 wt. %, respectively. When the content of Fe and Si exceeds 0.2 wt. %, Fe and Si form coarse intermetallic compounds which lower the elongation of the alloy sheet. Further, the hot workability of the alloy is also lowered (i.e., cracks are generated).

When the strength and deep drawing formability of the alloy sheet needs to be further improved, Cu should be added in the range of 0.05 to 1.0 wt. %.

When Cu content is less than 0.05 wt. %, the addition of Cu is ineffective. On the other hand, when the Cu content exceeds 1.0 wt. %, the hot workability of the alloy is rapidly lowered.

If the total amount of Mn, Zr and V to be added is not more than 0.2 wt. %, the strength of the alloy sheet can be improved more or less without lowering the elongation thereof.

If the total content of Zn and the other inevitable impurities is not more than 0.3 wt. %, then there is no effect on the present invention.

Now, the detailed description will be given with respect to why the manufacturing conditions were selected as described above.

First, an aluminum alloy slab having the above-mentioned component composition is homogenized at 450° to 540° C. for not more than 24 hours. The homogenization is carried out to obtain a uniform distribution of the solute atoms in the alloy slab and to homogenize the structure of the annealed alloy sheet so as to improve the strength and elongation of the alloy sheet.

When the temperature for homogenization is less than 450° C., the slab is not sufficiently homogenized. On the other hand, when the temperature for homogenization exceeds 540° C. or the time for homogenization exceeds 24 hours, the loss of Mg due to oxidation becomes remarkable, and the hot rolling cracks are easily generated.

Next, the homogenized aluminum alloy slab is subjected to hot rolling.

In the hot rolling step, it is desirable to set each reduction per pass of at least the initial three times of rolling pass to be no more than 3%. This prevents the generation of hot rolling cracks.

Further, it is desirable that the grain diameter of the homogenized alloy slab is no more than 1000 μm and the hot mill entrance temperature is set in the range of 320° to 470° C. This also prevents the generation of hot rolling cracks.

Immediately after the hot rolling step or on the way to the cold rolling step followed by the hot rolling, precipitation treatment of intermetallic compounds containing Cr is carried out at least once at 230° to 360° C. for 1 to 100 hours. The intermetallic compounds containing Cr ($A_7Cr$ or $Al_{18}Mg_3Cr_2$) with a mean diameter of not more than 0.2 μm are dispersed and precipitated in the range of 0.1 to 0.5 vol. % into the structure of the alloy sheet.

The dispersed intermetallic compounds containing Cr control the grain boundary migration of recrystallized grains in the final annealing of the alloy sheet. This regulates the grain growth, so that the grains in the structure of the alloy sheet after the final annealing are finer. Therefore, the strength and deep drawing formability of the alloy sheet is improved.

In the precipitation treatment, when the temperature for precipitation treatment is less than 230° C. or the time for precipitation treatment is less than one hour, the precipitation treatment is ineffective. On the other hand, when the temperature for precipitation treatment exceeds 360° C., the intermetallic compounds containing Cr become coarse. Therefore, the precipitation treatment at temperatures greater than 360° C. is ineffective when trying to make the grains of the alloy sheet structure finer in the final annealing. The strength and deep drawing formability of the alloy sheet is lowered.

The alloy sheet is then subjected to high-temperature and short-time annealing at 400° to 500° C. for not more than 120 seconds by, for instance, a continuous annealing line (CAL) or the like. The mean grain diameter of the metal structure of the alloy sheet is finer, in the range of 5 to 30 μm.

In the alloy sheet manufactured as described above, the finer the grains are, the more both the strength and deep drawing formability are improved. However, when the mean grain diameter of the alloy sheet structure is less than 5 μm, the reduction of the elongation becomes remarkable, and the deep drawing formability is also lowered.

When the mean grain diameter of the alloy sheet structure exceeds 30 μm, both the strength and deep drawing formability of the alloy sheet is lowered.

When the mean grain diameter of the alloy sheet structure is in the range of 10 to 25 μm, then the deep drawing formability of the alloy sheet is maximized.

Since the mean grain diameter of the metal structure of the aluminum alloy sheet is regulated to be in the range of 5 to 30 μm, the alloy sheet not only improves in strength and deep drawing formability, but also has the following characteristics.

Namely, the generation of Lüders lines (surface strain figures) can be prevented at the time of deep drawing press-forming of the alloy sheet.

Further, the brittleness in processing is extremely improved in the extensive temperature environment (e.g, −100° C. to room temperature). As a result, there is no possibility that the materials become brittle and cracked even in case of press forming under a low temperature environment. Furthermore, there is no possibility that the press-formed products become brittle when used in a low temperature environment and become cracked upon weak impact.

When the temperature for high-temperature and short-time annealing is less than 400° C., the recrystallization is ineffective. The mean grain diameter of the alloy sheet structure becomes less than 5 μm even though recrystallization is done. On the other hand, when the temperature for the above-mentioned annealing exceeds 500° C., the mean grain diameter exceeds 30 μm. As a result, in either case, the deep drawing formability of the alloy sheet is lowered.

According to the high-temperature and short-time annealing under the conditions described above, there is no change in the distributive state of the intermetallic compounds containing Cr in the alloy sheet structure before and after the annealing. Therefore, the distributive state of the intermetallic compounds containing Cr before the annealing remains the same.

Further, according to the annealing conditions described above, since the recrystallized grains are equiaxed grains, the grain diameters can be equally measured when being observed either from the sheet surface or from the sheet cross section.

When the final annealing described above is carried out in a batch-type furnace, anisotropy is yielded in strength, even if the grain diameter is in the range of 5 to 30 μm. The resultant alloy sheet tends to lower both the elongation and the formability.

The alloy sheet subjected to the final annealing as described above may be subjected to straightening by a tension leveler, a roller leveler, skin pass rolling or like means. Otherwise, the surface of the finally annealed alloy sheet may be washed with acid or alkali.

The aluminum alloy sheet manufactured as described above has superior strength and deep drawing formability than those of other aluminum alloy sheets. It can be used as sheet materials for press forming of auto body panels, air cleaners and oil tanks or the like. Further, the generation of Lüders lines can be restrained at the time of deep drawing press-forming. Furthermore, the aluminum alloy sheet of the invention has excellent characteristics of brittleness-resistance in processing under extensive temperature environment (e.g., −100° C. to room temperature).

The above, and other objects, features and advantages of the present invention will become apparent from the following description read in conjunction with the accompanying drawings, in which like reference numerals designate the same elements.

DESCRIPTION OF THE PREFERRED EMBODIMENT

Figure 1:
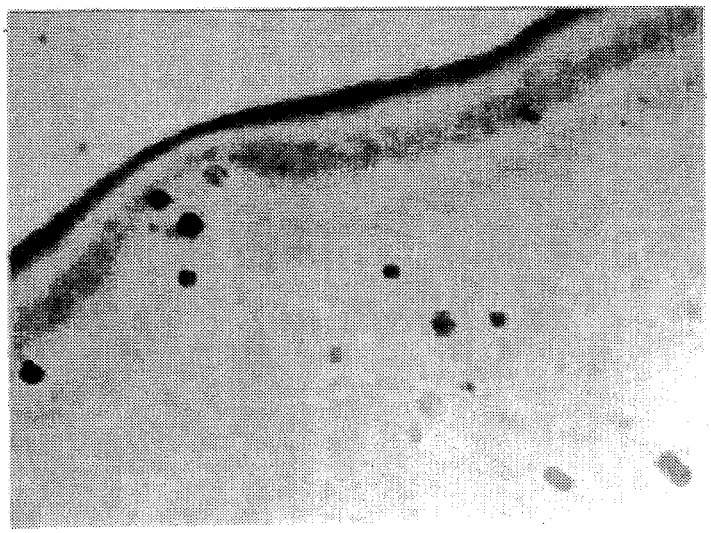
FIG. 1 is an enlarged-scale photograph of a metal structure of an aluminum alloy sheet according to an embodiment of the invention.

Hereinafter will be described an aluminum alloy sheet and a process for manufacturing same according to the invention in detail on the basis of the following examples.

First Example

Aluminum alloys having compositions similar to alloy samples Nos. 1 to 16 shown in Table 1 were subjected to DC casting (thickness: 400 mm, width: 1650 mm, and length: 4500 mm) by a normal process. Then each of the resultant alloy slabs was homogenized at 490° C. for 3 hours, and then subjected to hot rolling up to 5 mm in thickness under the following conditions.

Hot mill entrance temperature : 460° C.

Reduction per pass at the initial three times of rolling pass: 2%

Reduction per pass on and after the 4th rolling pass: gradual increase in the range of 3 to 45%

Total pass times: 28 times

Incidentally, the alloys of alloy samples Nos. 1 to 5 in Table 1 have compositions corresponding to an aluminum alloy sheet according to an embodiment of the invention and of a process of manufacturing the same. The alloys of alloy samples Nos. 6 to 8 have the compositions corresponding to of an aluminum alloy sheet according to another embodiment of the invention and of another process of manufacturing the same.

The alloys of alloy samples Nos. 9 to 16 are comparative examples, which have compositions outside the range of the invention.

In each of the alloy samples given in Table 1, a Cu content of less than 0.05 wt. % is considered an impurity.

The alloy sheet subjected to hot rolling as described above, was then subjected to cold rolling up to 2 mm in thickness. The alloy sheet was then subjected to precipitation treatment at 300° C. for 8 hours. It was then further subjected to final cold rolling up to 1 mm in thickness, and then heated for recrystallization at 480° C. for 20 seconds in a continuous annealing line (CAL) to manufacture O stock.

The section of the alloy sheet thus manufactured was subjected (photographed) to optical microscopic observation at a magnification of 100. The mean grain diameter of the metal structure in the alloy sheet was measured according to a crosscut method.

The tensile strength, proof stress and elongation of each alloy sheet described above were measured by a tension test. A test on deep drawing formability was conducted by a deep drawing test machine under the following conditions. The limit drawing height was measured to evaluate the deep drawing formability.

Dimension and shape of blank: 100 mm□ (100×100 mm)
Dimension and shape of punch: 50 mm□ (50×50 mm)
Dimension and shape of dies: 52 mm□ (52×52 mm)
Punch shoulder radius: 5 mm
Dies shoulder radius: 3 mm
Blank folding force: 2500 Kg Further, a thinned specimen (thickness: 2800 to 3500 Å) of the finally annealed alloy sheet described above was prepared according to a jet grinding method by use of a mixed solution of nitric acid and methanol (volume ratio of 1:2). This thinned specimen was then observed by a transmission electron microscope under an acceleration voltage of 200 Kv and at a magnification of 40000. The resultant electromicroscopic photos (30 visual fields) were analyzed by an image analyzer to calculate the mean diameter and dispersed amount of intermetallic compounds containing Cr.

In addition, it was confirmed by the analytical technique described above that the dispersive state of the intermetallic compounds containing Cr of the alloy sheet after the completion of the precipitation treatment described above is identical with that after the final annealing.

The results thus obtained from the measurement, observation and calculation are given in Table 2.

TABLE 1

| Alloy Sample | | Alloy Compositions (Wt. %) | | | | | | | | |
|---|---|---|---|---|---|---|---|---|---|---|
| No. | Classification | Mg | Be | Cr | Ti | B | Cu | Fe | Si | Al |
| 1 | Example of the Invention | 5.4 | 0.0008 | 0.02 | 0.01 | 0.00050 | 0.02 | 0.08 | 0.06 | Remainders |
| 2 | Example of the Invention | 6.5 | 0.0009 | 0.03 | 0.01 | 0.00008 | 0.02 | 0.07 | 0.04 | Remainders |
| 3 | Example of the Invention | 7.8 | 0.0037 | 0.01 | 0.02 | 0.00060 | — | 0.12 | 0.08 | Remainders |
| 4 | Example of the Invention | 8.2 | 0.0015 | 0.04 | 0.01 | 0.00071 | 0.02 | 0.05 | 0.03 | Remainders |
| 5 | Example of the Invention | 0.4 | 0.0020 | 0.04 | 0.02 | 0.00081 | 0.01 | 0.04 | 0.01 | Remainders |
| 6 | Example of the Invention | 6.5 | 0.0009 | 0.03 | 0.01 | 0.00009 | 0.21 | 0.15 | 0.16 | Remainders |
| 7 | Example of the Invention | 7.8 | 0.0037 | 0.01 | 0.02 | 0.00061 | 0.45 | 0.16 | 0.11 | Remainders |
| 8 | Example of the Invention | 8.2 | 0.0015 | 0.04 | 0.01 | 0.00071 | 0.82 | 0.02 | 0.01 | Remainders |
| 9 | Comparative Example | 4.7 | 0.0015 | 0.04 | 0.01 | 0.00070 | 0.05 | 0.25 | 0.22 | Remainders |
| 10 | Comparative Example | 8.1 | 0.0015 | 0.02 | 0.001 | 0.000004 | 0.06 | 0.35 | 0.15 | Remainders |
| 11 | Comparative Example | 7.5 | 0.0020 | 0.003 | 0.01 | 0.00080 | 0.08 | 0.12 | 0.15 | Remainders |
| 12 | Comparative Example | 7.4 | 0.0004 | 0.18 | 0.01 | 0.00070 | 0.02 | 0.18 | 0.09 | Remainders |
| 13 | Comparative Example | 8.0 | 0.0022 | 0.02 | 0.01 | 0.00071 | 1.25 | 0.08 | 0.07 | Remainders |
| 14 | Comparative Example | 12.0 | 0.0022 | 0.02 | 0.01 | 0.00075 | — | 0.05 | 0.04 | Remainders |
| 15 | Comparative Example | 8.2 | 0.00003 | 0.02 | 0.004 | 0.00038 | 0.02 | 0.21 | 0.05 | Remainders |
| 16 | Comparative Example | 8.2 | 0.0015 | 0.04 | 0.15 | 0.00045 | — | 0.14 | 0.10 | Remainders |

TABLE 2

| Alloy Example No. | Classification | Mean Diameter of Inter-metallic Compounds Containing Cr (μm) | Dispersed Amount of Inter-metallic Compounds Containing Cr (vol. %) | Mean Grain Diameter after Annealing (μm) | Tensile Strength (Mpa) | Proof Stress (Mpa) | Elongation (%) | Limit Drawing Height (mm) |
|---|---|---|---|---|---|---|---|---|
| 1 | Example of the Invention | 0.11 | 0.18 | 18 | 340 | 145 | 36 | 22 |
| 2 | Example of the Invention | 0.07 | 0.20 | 20 | 355 | 154 | 37 | 23 |
| 3 | Example of the Invention | 0.09 | 0.15 | 25 | 360 | 143 | 38 | 24 |
| 4 | Example of the Invention | 0.08 | 0.25 | 12 | 365 | 155 | 38 | 25 |
| 5 | Example of the Invention | 0.09 | 0.33 | 9 | 370 | 150 | 40 | 27 |
| 6 | Example of the Invention | 0.12 | 0.20 | 18 | 360 | 152 | 38 | 28 |
| 7 | Example of the Invention | 0.11 | 0.14 | 23 | 370 | 149 | 38 | 25 |
| 8 | Example of the Invention | 0.07 | 0.29 | 10 | 372 | 152 | 38 | 26 |
| 9 | Comparative Example | 0.10 | 0.25 | 20 | 280 | 115 | 27 | 14 |
| 10 | Comparative Example | — | — | — | — | — | — | — |
| 11 | Comparative Example | 0.01 | 0.02 | 55 | 301 | 115 | 38 | 18 |
| 12 | Comparative Example | 0.25 | 0.90 | 8 | 390 | 205 | 21 | 16 |
| 13 | Comparative Example | — | — | — | — | — | — | — |
| 14 | Comparative Example | — | — | — | — | — | — | — |
| 15 | Comparative Example | — | — | — | — | — | — | — |
| 16 | Comparative Example | 0.12 | 0.25 | 15 | 350 | 145 | 15 | 16 |

As apparent from the results shown in Table 2, each of the sheets manufactured from the alloys of alloy samples No. 1 to 8 of the invention has superior strength and deep drawing formability.

On the other hand, each of the sheets manufactured from the alloy of alloy sample No. 9, which has a small content of Mg and a slightly high content of Fe and Si, is inferior in both deep drawing formability and elongation.

With respect to alloy of the alloy sample No. 10, which has a small content of Ti and B and a high content of Fe, the grain diameter after the casting is large. Therefore, hot rolling cracks were generated, making manufacture of the alloy sheet impossible.

With respect to the sheet manufactured from the alloy of alloy sample No. 11, which has a small content of Cr, the dispersed amount of the intermetallic compounds containing Cr is small and the grain diameter after the final annealing is large. Therefore, the strength is low and the deep drawing formability is poor.

With respect to the sheet manufactured from the alloy of alloy sample No. 12, which has a high content of Cr, the elongation is low and the deep drawing formability is poor.

With respect to the alloy of alloy sample 13, which has a high content of Cu and the alloy of alloy sample No. 14, which has a high content of Mg, the hot rolling cracks were generated, making the manufacture of the alloy sheet impossible.

With respect to the alloy of alloy sample No. 15, which has a small content of Be, the cracks were generated at the time of casting, making manufacture of the alloy sheet impossible.

With respect to the sheet manufactured from the alloy of alloy sample No. 16, which has a high content of Ti, the elongation is low, and the deep drawing formability is poor.

Second Example

The hot rolled alloy sheet (thickness: 5 mm), manufactured from alloy of the alloy sample No. 4 in Table 1, was successively subjected to cold rolling, precipitation treatment, final cold rolling and annealing, under the different conditions as shown in Cases Nos. 17 to 29 in Table 3, respectively, to prepare an aluminum alloy sheet with a thickness of 1 mm.

The mean grain diameter of the aluminum alloy sheet thus manufactured was measured, and the tensile strength, proof stress and elongation thereof were also measured by a tension test. Further, a test on deep drawing formability was conducted under the same conditions as in the first example. Then, the limit drawing height was measured to evaluate the deep drawing formability.

The results obtained are shown in Table 4.

The manufacturing conditions in Cases Nos. 17 to 21 in Table 3 are those embodied by the manufacturing process of the invention. The manufacturing conditions in Cases No. 22 to 29 are manufacturing process outside the scope of the invention.

TABLE 3

| Case No. | Classification | Cold Rolling (mm) | Precipitation Treatment Temp. (°C.) | Precipitation Treatment Time (Hr) | Cold Rolling (mm) | Annealing Conditions Time (°C.) | Annealing Conditions Temp. (Hr) | Mean Diameter of Intermetallic Compounds Containing Cr (μm) | Dispersed Amount of Intermetallic Compounds Containing Cr (%) |
|---|---|---|---|---|---|---|---|---|---|
| 17 | Example of the Invention | None | 260 | 24 | 5 → 1 | 440 | 60 | 0.04 | 0.15 |
| 18 | Example of the Invention | 5 → 2 | 280 | 18 | 5 → 1 | 450 | 45 | 0.06 | 0.20 |
| 19 | Example of the Invention | 5 → 3 | 320 | 12 | 5 → 1 | 460 | 25 | 0.08 | 0.23 |
| 20 | Example of the Invention | None | 330 | 10 | 5 → 1 | 460 | 20 | 0.08 | 0.28 |
| 21 | Example of the Invention | 5 → 2 | 280 | 10 | 5 → 1 | 480 | 20 | 0.09 | 0.20 |
| 22 | Comparative Example | None | None | None | 5 → 1 | 480 | 20 | 0.11 | 0.06 |
| 23 | Comparative Example | None | 170 | 3 | 5 → 1 | 480 | 20 | 0.01 | 0.05 |
| 24 | Comparative Example | None | 300 | 0.1 | 5 → 1 | 480 | 30 | 0.07 | 0.04 |
| 25 | Comparative Example | 5 → 3 | 420 | 10 | 5 → 1 | 480 | 30 | 0.49 | 0.95 |
| 26 | Comparative Example | None | None | None | 5 → 1 | 520 | 40 | 0.02 | 0.04 |
| 27 | Comparative Example | 5 → 2 | 400 | 10 | 5 → 1 | 520 | 30 | 0.32 | 0.85 |
| 28 | Comparative Example | 5 → 3 | 320 | 10 | 5 → 1 | 540 | 30 | 0.08 | 0.25 |
| 29 | Comparative Example | 5 → 3 | 320 | 10 | 5 → 1 | 490 | 360 | 0.08 | 0.25 |

TABLE 4

| Case No. | Classification | Mean Grain Diameter after Annealing (μm) | Tensile Strength (Mpa) | Proof Stress (Mpa) | Elongation (%) | Limit Drawing Height (mm) |
|---|---|---|---|---|---|---|
| 17 | Example of the Invention | 15 | 355 | 150 | 37 | 28 |
| 18 | Example of the Invention | 16 | 352 | 148 | 37 | 27 |
| 19 | Example of the Invention | 22 | 350 | 155 | 38 | 28 |
| 20 | Example of the Invention | 19 | 351 | 150 | 37 | 27 |
| 21 | Example of the Invention | 25 | 348 | 149 | 38 | 26 |
| 22 | Comparative Example | 45 | 315 | 120 | 37 | 14 |
| 23 | Comparative Example | 40 | 320 | 119 | 36 | 15 |
| 24 | Comparative Example | 45 | 315 | 120 | 36 | 17 |
| 25 | Comparative Example | 45 | 315 | 124 | 37 | 15 |
| 26 | Comparative Example | 55 | 300 | 104 | 36 | 14 |
| 27 | Comparative Example | 75 | 292 | 95 | 35 | 13 |
| 28 | Comparative Example | 80 | 280 | 97 | 32 | 12 |
| 29 | Comparative Example | 72 | 285 | 101 | 30 | 13 |

As apparent from Tables 3 and 4, each of the aluminum alloy sheets in Cases Nos. 17 to 21, done according to an embodiment of the process of the invention, is excellent in not only elongation and strength but also deep drawing formability.

On the other hand, with respect to each of the alloy sheets in Cases Nos. 22 and 26, in which the precipitation treatment was not carried out, and each of the alloy sheets in Cases Nos. 23 and 24, in which the temperature for precipitation treatment is lower than that required by the invention or the time for precipitation treatment is shorter than that required by the invention, the dispersed amount of the intermetallic compound containing Cr in the metal structure of each alloy sheet is small. With respect to each of the alloy sheets in Cases Nos. 25 and 27, in which the temperature for precipitation treatment is higher than that required by the invention, the intermetallic compounds containing Cr in the metal structure of each alloy sheet are coarse. The dispersed amount of the intermetallic compounds containing Cr becomes excessive. As a result, each of these alloy sheets has a mean grain diameter exceeding 30 μm after the annealing. Each is inferior in both strength and deep drawing formability as compared to each of the alloy sheets in Cases Nos. 17 to 21.

Further, with respect to each of the alloy sheets in Cases Nos. 28 and 29, in which the temperature for final annealing is higher than that required by the invention, or the time for annealing is longer than that required by the invention, each of the alloy sheets also has a mean grain diameter exceeding 30 μm after the annealing and is inferior in both strength and deep drawing formability as compared to each of the alloy sheets in Cases Nos. 17 to 21.

Figure 2:
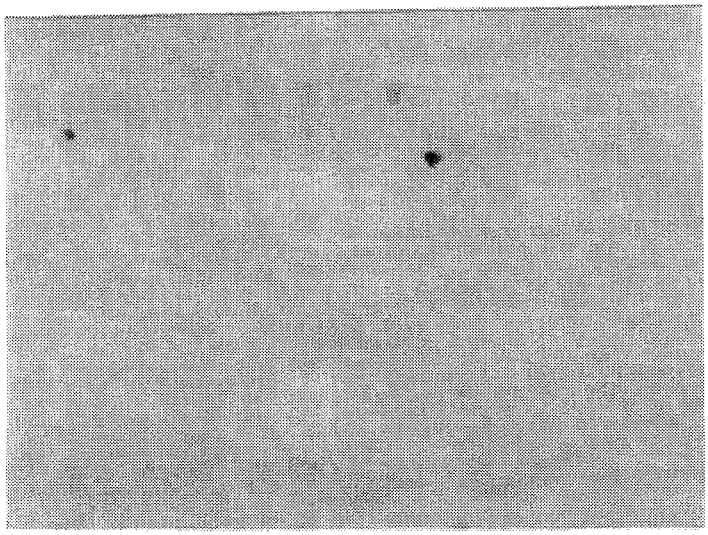
FIG. 2 is an enlarged-scale photograph of a metal structure of an aluminum alloy sheet manufactured independently of the invention.

The transmission electron microscopic photographs of thinned specimens (thickness: 0.28 μm) of the alloy sheets in Cases Nos. 19 and 22 are shown in FIGS. 1 and 2 respectively.

FIG. 1 shows a transmission electron microscopic image of the metal structure of the finally annealed alloy sheet in Case No. 19, as an example of an embodiment of the invention. In this example 0.23 vol. % of the intermetallic compounds containing Cr with the mean grain diameter of 0.08 μm are dispersed.

On the other hand, with respect to the alloy sheet in Case No. 22, used as a comparative example, the mean grain diameter of the intermetallic compounds containing Cr in the structure of this alloy sheet is 0.11 μm, and the dispersed amount thereof is 0.6 vol. %.

The aluminum alloy sheet according to the invention is excellent in both strength and deep drawing formability. The characteristics are approximately comparable to those of the cold rolled steel sheet. Furthermore, the generation of L üders line at the time of deep drawing press-forming becomes very difficult. Further, the aluminum alloy sheet according to the invention and the press-formed product thereof have excellent characteristics of brittleness-resistance in processing under extensive temperature environments, in particular under a low-temperature environment.

According to the process of manufacturing the aluminum alloy sheets of the invention, the aluminum alloy sheets having the characteristics described above can be manufactured industrially.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A process for manufacturing Al-Mg based alloy sheets for press forming, comprising:

preparing an Al-Mg based alloy slab including at least 5 to 10 weight percent of Mg;

homogenizing said alloy slab at a homogenizing temperature for a period of time effective to homogenize said alloy slab;

hot rolling said alloy slab at a hot mill entrance temperature;

carrying out a precipitation treatment of an intermetallic compound containing Cr at a precipitation temperature of 230° to 360° C. to provide an Al-Mg alloy sheet, wherein said intermetallic compound containing Cr has a mean diameter of not more than 0.2 μm and is precipitated in a range from 0.1 to 0.5 volume percent;

cold rolling said alloy sheet to a thickness of about 3 mm; and heating said alloy sheet to a heating temperature for a period of time not exceeding 120 seconds to anneal and recrystallize grain growth of said Al-Mg alloy from 5 to 30 μm in diameter.

2. The process of claim 1, wherein said step of homogenizing said alloy slab at a homogenizing temperature for a period of time effective to homogenize said alloy slab includes a period of time not exceeding 24 hours.

3. The process of claim 1, wherein said step of heating said alloy to a heating temperature for a period of time effective to anneal and recrystallize grain growth of said Al-Mg alloy from 5 to 30 μm in diameter includes a heating temperature of from about 400° to about 500° C.

4. The process of claim 1, wherein said Al-Mg alloy slab, by weight percentage, further includes:

from about 0.0001 to about 0.01 percent of Be;

from about 0.01 to about 0.05 percent of Cr;

from about 0.005 to about 0.1 percent of Ti;

from about 0.00001 to about 0.05 percent B; and a balance substantially Al and inevitable impurities consisting essentially of Fe and Si, wherein said Fe and said Si being less than 0.2 percent.

5. The process of claim 4, wherein said Al-Mg alloy slab, by weight percentage, further includes:

from about 0.05 to about 1.0 percent of Cu.

6. The process of claim 1, wherein said homogenized alloy has an average grain diameter of no more than 1000 μm.

7. The process of claim 1, wherein said precipitation treatment is carried out for 1 to 100 hours.

8. The process according to claim 1, wherein said intermetallic compound is at least one material selected from the group consisting of $Al_7Cr$ and $Al_{18}Mg_3Cr_2$.

9. The process according to claim 1, wherein said step of heating said alloy sheet to a heating temperature for a period of time not exceeding 120 seconds to anneal and recrystallize grain growth of said Al-Mg alloy from 10 to 25 μm.

* * * * *